US006074484A

United States Patent [19]

Higuti et al.

[11] Patent Number: 6,074,484

[45] Date of Patent: Jun. 13, 2000

[54] PAINTING TOOL

[75] Inventors: Masaru Higuti; Mitsuru Nagaya; Seiichi Takeuchi, all of Hyogo-ken, Japan

[73] Assignee: Mitsubishi Heavy Industries, Ltd., Tokyo, Japan

[21] Appl. No.: 09/010,125

[22] Filed: Jan. 21, 1998

[51] Int. Cl.[7] ..... B05C 5/02

[52] U.S. Cl. ..... 118/668; 118/305; 118/323

[58] Field of Search ..... 118/323, 305, 118/668; 239/264, 292, 227

[56] References Cited

U.S. PATENT DOCUMENTS

| | | | |
|---|---|---|---|
| 4,125,035 | 11/1978 | Dooley | 118/323 |
| 4,501,223 | 2/1985 | Matsuno et al. | 118/305 |
| 4,850,382 | 7/1989 | Williams | 118/323 |
| 4,944,243 | 7/1990 | Takeno et al. | 118/305 |
| 5,240,503 | 8/1993 | Levy et al. | 118/323 |

FOREIGN PATENT DOCUMENTS

| | | |
|---|---|---|
| 1.290.364 | 3/1992 | France . |
| 1 577 792 | 2/1970 | Germany . |
| 1 805 145 | 9/1970 | Germany . |
| 2 425 475 | 12/1974 | Germany . |
| 40 29 027 A1 | 3/1991 | Germany . |
| 296 09 481 U1 | 1/1997 | Germany . |
| 57-197063 | 12/1982 | Japan . |
| 64-4273 | 1/1989 | Japan . |
| 1-297165 | 11/1989 | Japan . |
| 5-104046 | 4/1993 | Japan . |
| 6-269709 | 9/1994 | Japan . |
| 1109021 | 4/1968 | United Kingdom . |
| 2 020 203 | 11/1979 | United Kingdom . |
| 2 190 312 | 11/1987 | United Kingdom . |
| 2 246 963A | 2/1992 | United Kingdom . |

*Primary Examiner*—Laura Edwards
*Attorney, Agent, or Firm*—Armstrong, Westerman, Hattori, McLeland & Naughton

[57] ABSTRACT

The object of the present invention is to provide a painting tool which, even when there is an obstacle on a moving path thereof, the painting tool can pass through a gap between the obstacle and a surface to be painted, thereby allowing a painting area to increase. A first reciprocating mechanism is attached to a painting tool supporting member, a second reciprocating mechanism is attached to a movable part of the first reciprocating mechanism, a first hood is attached to the first reciprocating mechanism so as to cover an upper part of the second reciprocating mechanism, a second hood is attached to the painting tool supporting member so as to surround a lower part of the second reciprocating mechanism, a third hood is disposed between the first hood and the second hood, a suction nozzle is attached to the first hood, and a painting spray gun is attached to a movable part of the second reciprocating mechanism.

26 Claims, 6 Drawing Sheets

BACKGROUND ART

BACKGROUND ART

BACKGROUND ART

BACKGROUND ART

PAINTING TOOL

BACKGROUND OF THE INVENTION

1. Field of the Invention

This invention relates to a painting tool applicable to painting of a large-scale structure.

2. Description of Background Art

FIGS. 6 and 7 show an example of conventional painting tool. This painting tool comprises a first hood 101, covering a part of a surface to be painted (wall surface) 100 as being supported by a wall-surface working device (not depicted) movable along the surface to be painted 100; a second hood 103 disposed within the first hood 101 via a driving means 102 so as to be movable along the surface to be painted 100; a pair of painting rollers 104 disposed within the second hood 103 so as to face the surface to be painted 100 and come into contact therewith; and a spray gun 105 attached to the innermost wall of the second hood 103, so as to perform spray painting and roller painting in parallel.

FIGS. 8 to 10 show another example of conventional painting tool. This painting tool comprises a working truck 201, which is movable on a surface of a structure to be painted (wall surface) 200 by means of a wheel 201*a* and a magnet device (not depicted) as being remote-controlled by an operator; a plunger pump 202; a paint container 203; a chamber 204; airless spray guns 205, 205 attached to the working truck 201; a solenoid valve 206 for controlling an amount of paint emitted from each airless spray gun 205; a paint supply tube 207 extending to each airless spray gun 205; an arm 208 for linking the paint supply tubes 207 together; a pivotal axis 209 pivotally connecting a center part of the arm 208 to the working truck 201; a rotary axis 210 disposed in the working truck 201; a worm 211 attached to the rotary axis 210; a worm wheel 212, on the working truck 201 side, in mesh with the worm 211; a rod 213 linking an eccentric position of the worm wheel 212 with a member 208*a* on the arm 208 side; and a flexible paint supply hose 214 linking each paint supply tube 207 with the chamber 204. As the plunger pump 202 is operated, the painting tool draws in the paint contained within the paint container 203 and sends thus drawn paint to the chamber 204 by means of the pressurized air supplied from a compressor. After the amount of emission is controlled to a predetermined level at the chamber 204, the paint is successively fed to the paint supply hose 214, the paint supply tube 207, and the airless spray guns 205, 205, from which it is emitted onto the surface to be painted 200.

In the paint tool shown in FIGS. 6 and 7 and that shown in FIGS. 8 to 10, the distance between the tip portion of the spray nozzle and the surface to be painted (hereinafter referred to as spray distance) is set to a substantially constant level from the viewpoint of paintability.

When there is an obstacle such as piping on a moving path for painting, however, spray distance $+\alpha$ is necessary. In such a case, $\alpha$ becomes considerably large in the painting tool shown in FIGS. 6 and 7. In the painting tool shown in FIGS. 8 to 10, on the other hand, when the gap between the surface to be painted and an obstacle is smaller than the height of the working truck 201, the latter cannot pass through this gap, whereby its painting area may be disadvantageously narrowed.

SUMMARY OF THE INVENTION

In view of the foregoing problems, it is an object of the present invention to provide a painting tool which, even when there is an obstacle on a moving path of the painting tool, can pass though the gap between the obstacle and the surface to be painted, thereby making it possible to enlarge the painting area.

In order to achieve such an object, the painting tool in accordance with the present invention comprises:

- a painting tool supporting member;
- a first reciprocating mechanism attached to the painting tool supporting member;
- a second reciprocating mechanism attached to a movable part of the first reciprocating mechanism; and
- a painting spray gun attached to a movable part of the second reciprocating mechanism.

Preferably, a hood covering the second reciprocating mechanism is further provided.

Preferably, a suction nozzle for drawing in a painting mist from within the hood is further provided.

Preferably, the painting tool supporting member is attached to a working device running on a painting surface.

Preferably, the movable part of the first reciprocating mechanism is movable in directions moving toward and away from the painting surface.

Preferably, the movable part of the second reciprocating mechanism is movable in parallel to the painting surface.

Preferably, the movable part of the second reciprocating mechanism is movable in a direction crossing a running direction of the working device.

Preferably, the hood comprises a first hood attached to the movable part of the first reciprocating mechanism so as to cover an upper part of the second reciprocating mechanism; a second hood attached to the painting tool supporting member so as to cover a lower part of the second reciprocating mechanism; and a third hood disposed between the first and second hoods.

Preferably, the second hood is made elastic.

Preferably, the first reciprocating mechanism comprises a stationary part attached to the painting tool supporting member, and the movable part reciprocating with respect to the stationary part.

Preferably, the first reciprocating mechanism is constituted as a complex mechanism in which a plurality of reciprocating mechanisms each having the stationary and movable parts are disposed in parallel;

- of the plurality of reciprocating mechanisms, the stationary part of the reciprocating mechanism on one end side is attached to the painting tool supporting member, whereas the movable part thereof is attached to the stationary part of the reciprocating mechanism adjacent thereto on the other end side;
- of the plurality of reciprocating mechanisms, the stationary part of the reciprocating mechanism on the other end side is attached to the movable part of the reciprocating mechanism adjacent thereto on one end side, whereas attached to the movable part thereof is the second reciprocating mechanism; and
- of the plurality of reciprocating mechanisms, the stationary part of each of the other reciprocating mechanisms is attached to the movable part of a reciprocating mechanism adjacent thereto on one end side, whereas the movable part thereof is attached to the stationary part of a reciprocating mechanism adjacent thereto on the other end side.

Preferably, the first reciprocating mechanism is a fluid cylinder mechanism comprising a fluid pressure cylinder attached to the painting tool supporting member and a piston rod reciprocating within the fluid pressure cylinder.

Preferably, the second reciprocating mechanism has the movable part and elastic parts respectively disposed on both sides of the movable part, such that the movable part is driven when each length in the elastic parts is adjusted.

DESCRIPTION OF THE PREFERRED EMBODIMENTS

First Embodiment

In the following, the painting tool of the present invention will be explained with reference to the first embodiment shown in FIGS. 1 to 4.

Figure 1:
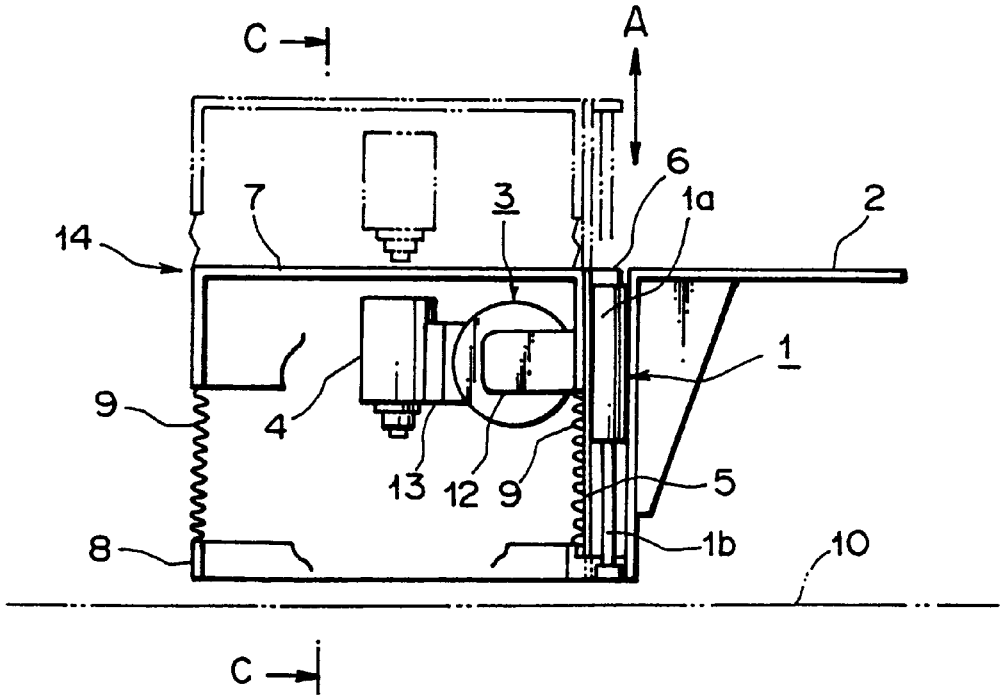
FIG. 1 is a front view showing a painting tool s a first embodiment of the present invention.
Figure 2:
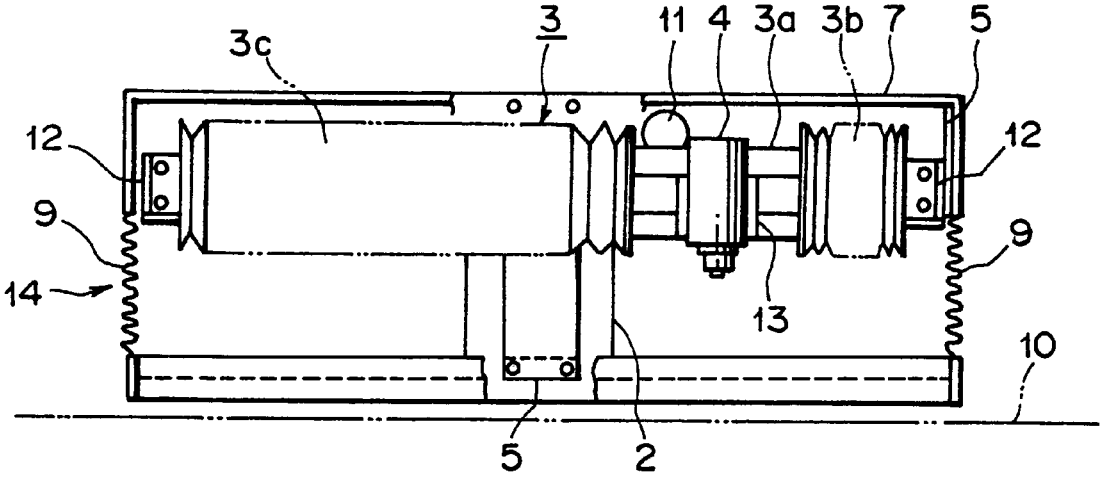
FIG. 2 is a vertical sectional view taken along line C—C in FIG. 1.
Figure 3:
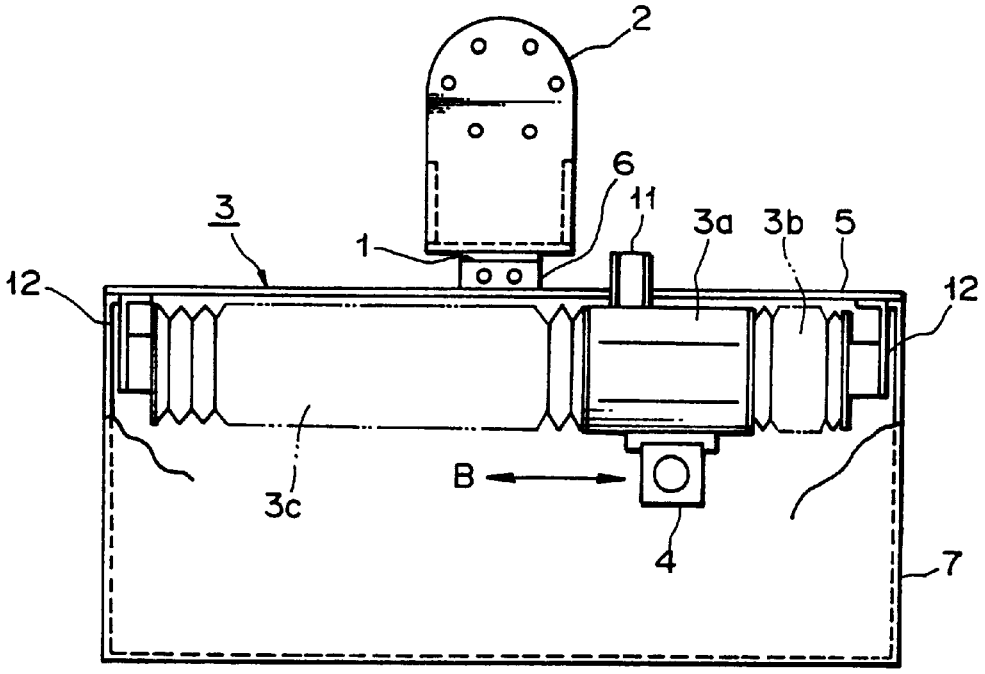
FIG. 3 is a plan view showing the painting tool as the first embodiment of the present invention.
Figure 4:
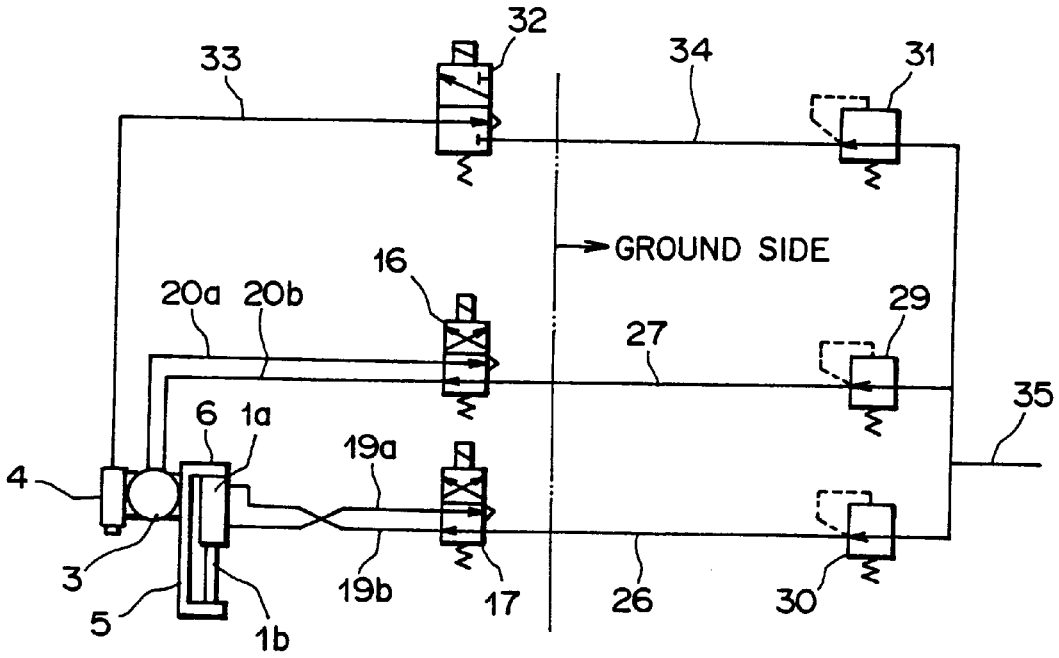
FIG. 4 is a diagram showing a piping system of a cylinder in the painting tool as the first embodiment of the present invention.

FIG. 1 is a front view of this painting tool; FIG. 2 is a vertical sectional view taken along line C—C in FIG. 1; FIG. 3 is a plan view showing the painting tool; and FIG. 4 is a diagram showing a piping system of a cylinder.

As shown in FIGS. 1 to 3, this painting tool comprises a first reciprocating mechanism 1; a painting tool supporting member 2; a second reciprocating mechanism (rodless cylinder with bellows) 3; a painting spray gun 4; a hood 14 constituted by a first hood 7, a second hood 8, and a third hood 9; and a suction nozzle 11.

Figure 8:
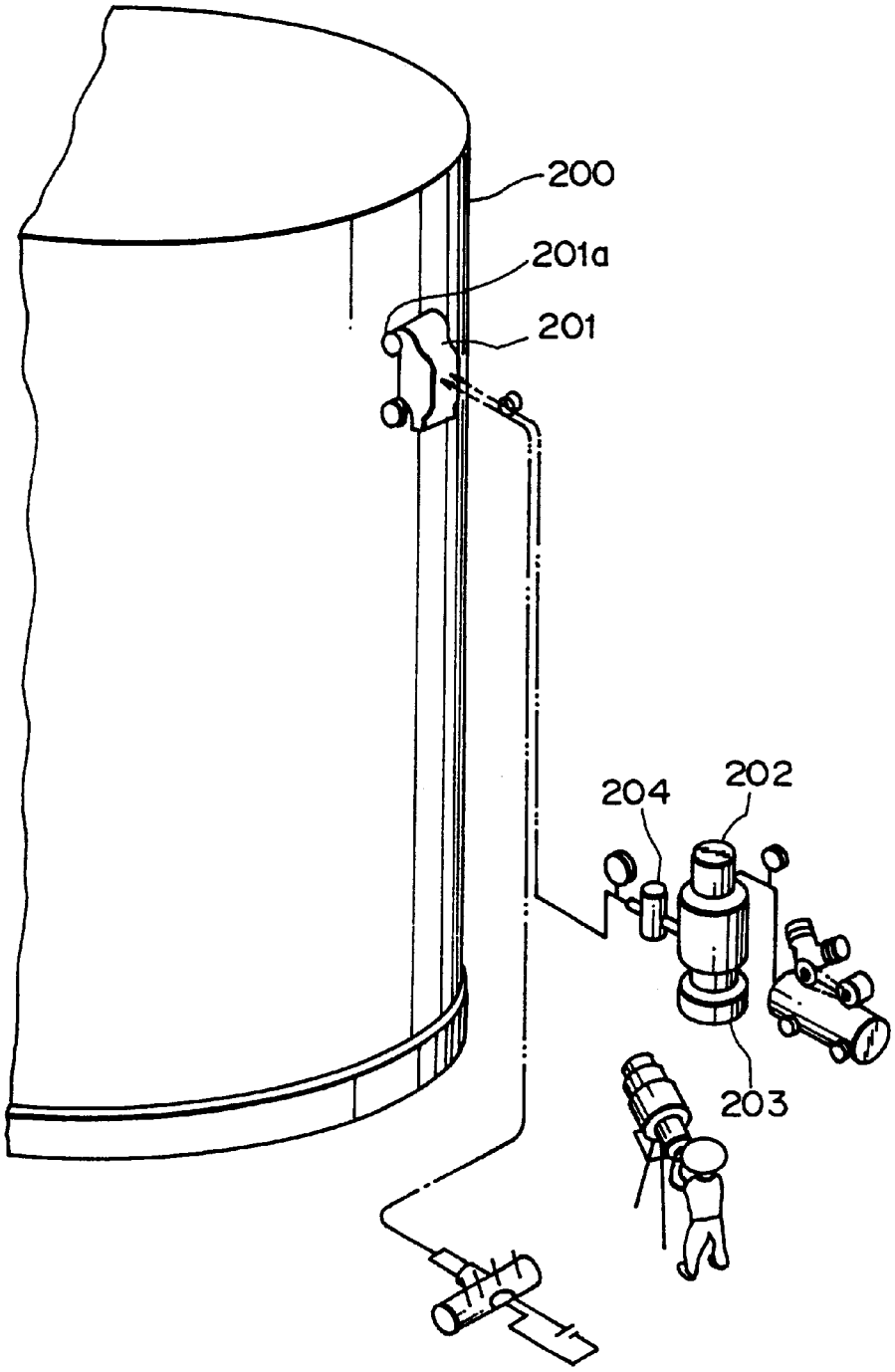
FIG. 8 is a perspective view showing another example of conventional painting tool.
Figure 9:
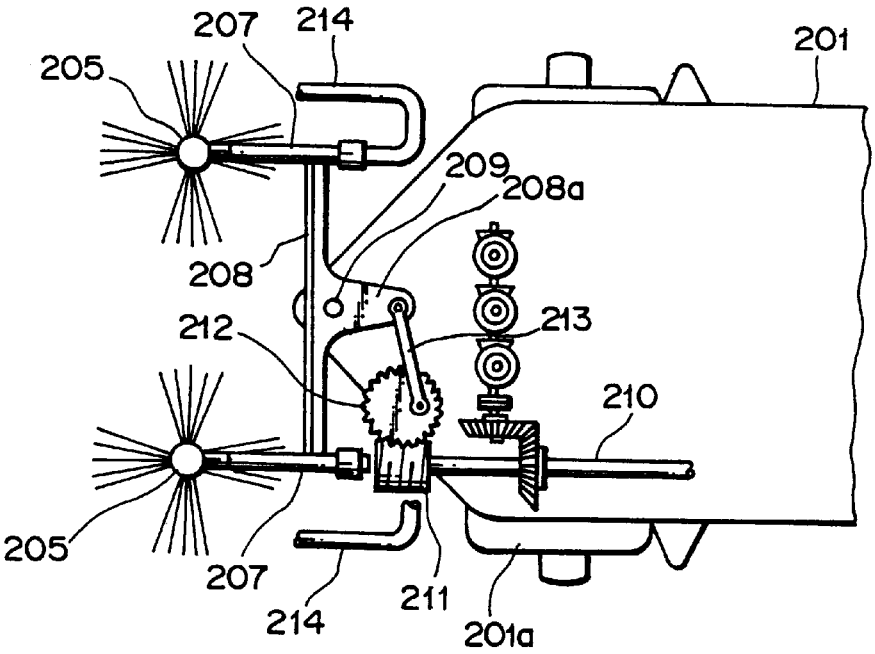
FIG. 9 is a plan view showing the painting tool shown in FIG. 8.
Figure 10:
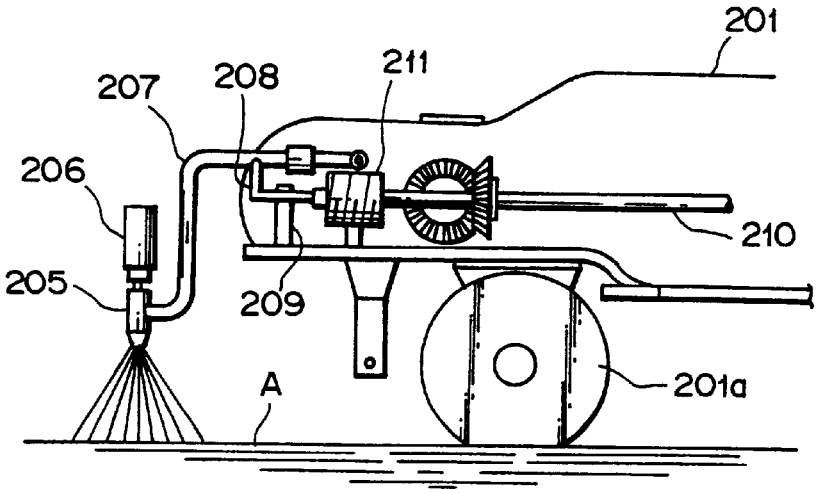
BACKGROUND ART FIG. 10
FIG. 10 is a side view showing the painting tool shown in FIG. 8.

The painting tool supporting member 2 is attached to a non-depicted working device (wall-surface working device). For example, this wall-surface working device is equipped with the working truck 201 explained as prior art with reference to FIGS. 8 to 10. Preferably employed as such a working truck is an automatically running truck equipped with a wheel for running on a surface of a structure to be painted, a magnetic device for holding the truck onto a magnetic surface to be painted, and the like, which is adapted to run on the surface to be painted as being remote-controlled.

The first reciprocating mechanism 1 is formed as a cylinder mechanism constituted by an air cylinder (stationary part) 1*a* and a piston rod (movable part) 1*b*. The air cylinder (fluid pressure cylinder) 1*a* of the first reciprocating mechanism 1 is secured to the painting tool supporting member 2, whereas the piston rod 1*b* is adapted to reciprocate in directions orthogonal to a surface to be painted 10 of a structure or the like (directions moving toward and away from the surface to be painted 10), as indicated by arrow A in FIG. 1.

Also, a bracket 6 is secured to the piston rod 1*b* of the first reciprocating mechanism 1, and a bracket 5 is further secured to the bracket 6. As shown in FIG. 3, the bracket 5 extends over the whole length of the second reciprocating mechanism 3. Brackets 12, 12 are respectively secured to both ends of the bracket 5.

The second reciprocating mechanism 3 is constituted by a movable part 3*a* and elastic parts (elastic bellows) 3*b* and 3*c*. Each of the elastic parts 3*b* and 3*c* is equipped with an air inlet and an air outlet (which are not depicted).

The painting spray gun 4 is attached to the movable part 3*a* of the second reciprocating mechanism 3 via a bracket 13. Outer end portions of the bellows 3*b* and 3*c* of the second reciprocating mechanism 3 are respectively secured to the brackets 12, 12. As air is supplied to one of the bellows 3*b* and 3*c* so as to make it expand, while the air is discharged from the other so as to make it contract, the movable part 3*a* and the painting spray gun 4 reciprocate in directions indicated by arrow B in FIG. 3. Namely, they move to-and-fro in parallel to the surface to be painted 10 of the structure.

The first hood 7 is attached to the bracket 5 on the piston rod 1*b* side of the first reciprocating mechanism 1, and covers an upper part of the second reciprocating mechanism 3, thereby preventing paint sprayed from the painting spray gun 4 from scattering outside.

The second hood 8 is attached to the painting tool supporting member 2 and surrounds a lower part of the second reciprocating mechanism 3, thereby preventing paint sprayed from the painting spray gun 4 from scattering outside.

The third hood 9 is an elastic bellows-like hood and is disposed between the first hood 7 and the second hood 8, and also prevents paint sprayed from the painting spray gun 4 from scattering outside.

The suction nozzle 11 is attached to the first hood 7 and is connected to an aspirator (not depicted) so as to draw in the paint mist from within the first hood 7 to third hood 9.

As shown in FIG. 4, the air cylinder 1*a* of the first reciprocating mechanism 1 is connected to an air source 35 via pipes 19*a*, 19*b*, and 26, a solenoid valve 17, and a pressure reducing valve 30. Under remote control, the solenoid valve 17 is switched (connection states of the pipes 19*a* and 19*b* with respect to the pipe 26 are switched), thereby moving up and down the brackets 6 and 5 and the second reciprocating mechanism 3. As shown in FIG. 4, when the solenoid valve 17 is turned OFF, the pipes 26 and 19*b* communicate with each other, whereby the bracket 6 descends together with the piston rod 1*b*.

The second reciprocating mechanism 3 (bellows 3*b*, 3*c*) is connected to the air source 35 via pipes 20*a*, 20*b*, and 27, a solenoid valve 16, and a pressure reducing valve 29. Under remote control, the solenoid valve 16 is switched (connection states of the pipes 20*a* and 20*b* with respect to the pipe 27 are switched), whereby the painting spray gun 4 reciprocates in parallel to the surface to be painted 10 of the structure.

The spray gun 4 is connected to the air source 34 via pipes 33 and 34, a solenoid valve 32, and a pressure reducing valve 31. While the solenoid valve 32 is switched An synchronization with a reciprocating timing of the second reciprocating mechanism 3 (pipes 33 and 34 are selectively communicated and disconnected with each other), paint is sprayed from the painting spray gun 4 so that the surface to be painted 10 of the structure is painted.

With such a configuration, the painting tool of the first embodiment performs painting by the painting pray gun 4, while the non-depicted wall-surface working device is operated. Here, while the painting tool itself runs on the surface to be painted 10 together with the wall-surface working device, as the solenoid valve 16 is appropriately switched so as to operate the second reciprocating mechanism 3, the painting spray gun 4 reciprocates in parallel to the surface to be painted 10.

Accordingly, while such movement of the paint tool itself accompanying the running wall-surface working device and the movement of the painting spray gun 4 caused by the second reciprocating mechanism 3 are linked with each other, a wide area of the surface to be painted 10 can be painted by means of the single painting spray gun 4.

The painting spray gun 4 can spray paint when the solenoid valve 32 is operated so that the pipes 33 and 34 communicate with each other so as to supply air to the painting spray gun 4. When the second reciprocating mechanism 3 causes the painting spray gun 4 to reciprocate, the solenoid valve 32 is operated in synchronization with the timing of this reciprocation so as to control the air supplied to the painting spray gun 4, thereby adjusting the paint spraying. As a result, the surface to be painted 10 can be uniformly painted.

Also, as the solenoid valve 17 is switched, the first reciprocating mechanism 1 can be operated when necessary, thus making it possible to adjust the vertical position of the painting spray gun 4.

Accordingly, even when there is an obstacle on a moving path of the painting tool, the painting spray gun 4 can lower its position so as not to interfere with the obstacle, whereby its movable area increases in spite of the obstacle, thus allowing its painting area to expand.

Also, since the hood 14 comprises the first hood 7 attached to the movable part (piston rod) 1*b* of the first reciprocating mechanism 1, the second hood 8 attached to the painting tool supporting member 2, and the third hood 9 disposed between the first hood 7 and second hood 8, while the third hood 9 is made elastic; the distance between the lower end of the hood 14 and the surface to be painted 10 can be held constant even when the first reciprocating mechanism 1 is operated to move the painting spray gun 4 up and down.

Consequently, while keeping the hood 14 from interfering with the surface to be painted 10, the paint sprayed from the paint spray gun 4 can be securely prevented from scattering outside the hood 14.

Also, the paint mist within the hood 14 can be securely drawn in and collected by the suction nozzle 11.

Therefore, without spraying paint onto parts where painting is unnecessary, a necessary surface to be painted can be securely painted, thus improving the efficiency in paint usage as well.

Though the solenoid valves 16 and 17 may be those of a simple ON/OFF switching type, their operability can improve when they are provided with an air supply and exhaust stop mode in addition to an air supply mode and an air exhaust mode.

Also, the solenoid valves 16 and 17 can be duty-controlled. In this case, as the solenoid valve 16 is duty-controlled, the second reciprocating mechanism 3 can be moved in a given direction at an appropriate speed or stopped. On the other hand, as the solenoid valve 17 is duty-controlled, the first reciprocating mechanism 1 can be moved in a given direction at an appropriate speed or stopped.

Second Embodiment

Figure 5:
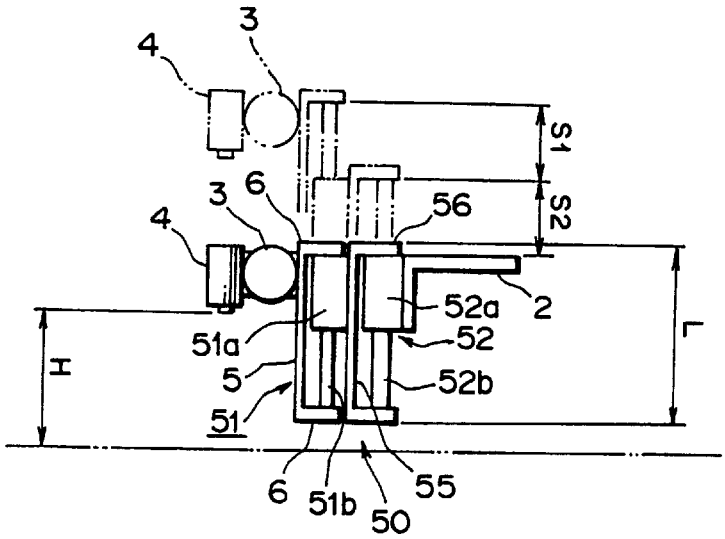
FIG. 5 is a front view showing a painting tool as a second embodiment of the present invention.
Figure 6:
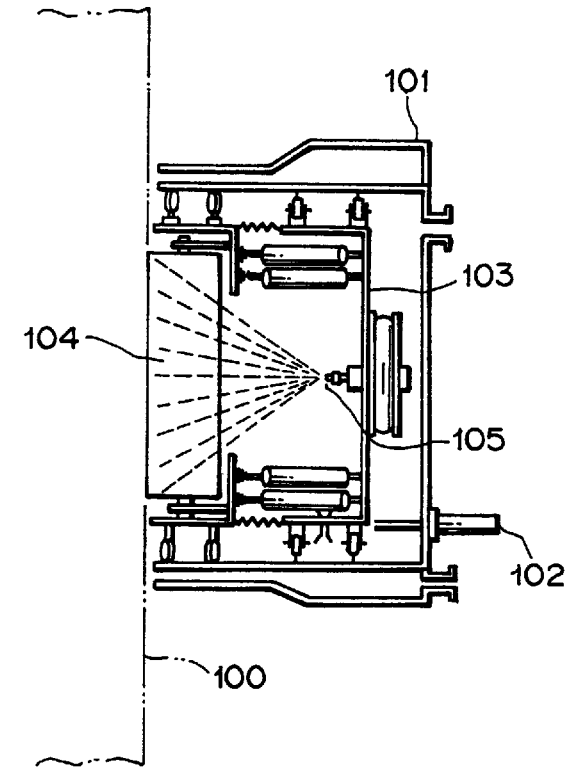
FIG. 6 is a vertical sectional view showing an example of conventional painting tool.
Figure 7:
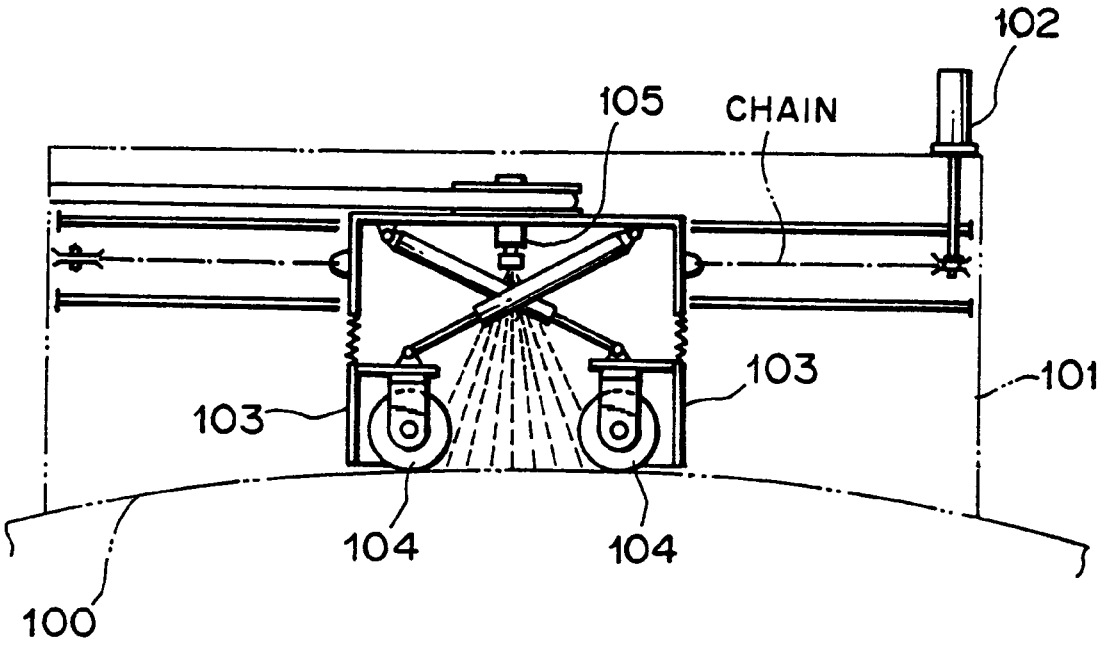
FIG. 7 is a transverse sectional view showing the painting tool shown in FIG. 6.

FIG. 5 shows a painting tool in accordance with the second embodiment of the present invention. In this embodiment, a first reciprocating mechanism 50 is equipped with two cylinder mechanisms (reciprocating mechanisms) 51 and 52, each of which comprises, as with the cylinder mechanism 1 as the first reciprocating mechanism of the first embodiment, an air cylinder (stationary part) 51*a*, 52*a* and a piston rod (movable part) 51*b*, 52*b*.

In the first cylinder mechanism 51, as with the first reciprocating mechanism 1 in the first embodiment, a bracket 6 is secured to the piston rod 51*b*, and a second reciprocating mechanism 3 similar to that in the first embodiment is connected thereto via a bracket 5 secured to the bracket 6 and brackets 12, 12 secured to the bracket 5.

In the second cylinder mechanism 52, on the other hand, the air cylinder 52*a* is secured to a painting tool supporting member 2, a bracket 56 is secured to the piston rod 52*b*, a bracket 55 is secured to the bracket 56, and the air cylinder 51*a* of the first cylinder mechanism 51 is secured to the piston rod 52*b* via the brackets 55 and 56.

In this embodiment, since the first reciprocating mechanism 50 has an enlarged range of vertical movement, the painting tool can further lower its height. For example, assuming that the first and second cylinders 51 and 52 are the same, S1=S2. In the case where only one cylinder mechanism is provided (i.e., in the case of the first embodiment), the height of the painting spray gun 4 is:

$$H+S1 \tag{1}$$

When a length L of an air cylinder is reduced by $\alpha$, the height of the painting spray gun 4 is:

$$H-\alpha+S1-\alpha=H+S1-2\alpha \tag{2}$$

The height of the painting tool is $L-\alpha$.

When one piece of the same cylinder is additionally attached thereto, the height of the painting spray gun 4 is (2)+S1−$\alpha$, namely:

$$H+S1-2\alpha+S1-\alpha$$

When $S1-\alpha>2\alpha$, the original height of the painting spray gun 4 can be secured. Therefore, when $\alpha$ is determined under the condition of $S1>3\alpha$, the height of the painting tool can be lowered by $\alpha$, whereby the height H+S1 of the painting spray gun 4 is secured.

Though the first reciprocating mechanism reciprocating in directions moving the movable part toward and away from the surface to be painted is configured such that two cylinder mechanisms (reciprocating mechanisms) 51 and 52 are linked together in each embodiment, a number of cylinder mechanisms (reciprocating mechanisms) may be further linked similarly.

Also, though one or a plurality of air cylinder mechanisms are provided as the first reciprocating mechanism in each embodiment, not only the air cylinder mechanism but also other fluid pressure cylinder mechanisms such as hydraulic cylinder may be employed as the first reciprocating mechanism. Further, not only the cylinder mechanism but also other mechanisms such as a reciprocating mechanism utilizing an electric motor may be used.

Similarly, though air pressure is utilized as the second reciprocating mechanism for driving the movable part in each embodiment, without being restricted thereto, other fluid pressures such as hydraulic pressure may used as well. Also, not only the fluid pressure mechanism but also other mechanisms such as a reciprocating mechanism utilizing an electric motor may be used.

Though the hood 14 is configured such that the first hood 7, second hood 8, and third hood 9 are connected together in each embodiment, the configuration of the hood 14 should not be restricted thereto. Namely, the hood 14 may be constituted by an elastic hood such as the third hood 9 alone. Also, the hood 14 may be configured such that the first hood 7 and second hood 8 overlap with each other, and their overlapping length may be changed so that the hood 14 has a variable length.

LEGEND

For Reference

Explanation of Letters and Numerals

1 first reciprocating mechanism
1*a* stationary part thereof
1*b* movable part thereof
2 painting tool supporting member
3 second reciprocating mechanism
3*a* stationary part thereof
3*b* elastic part thereof
3*c* elastic part thereof
4 painting spray gun
7 first hood
8 second hood
9 third hood
11 suction nozzle
5, 6, 12, 13 bracket
10 surface to be painted
14 hood
16, 17, 32 solenoid valve
19*a*, 19*b*, 20*a*, 20*b*, 26, 27, 33, 34 pipe
29, 30, 31 pressure reducing valve
35 air source

What is claimed is:

1. A painting tool adapted to be carried by a remotely controlled truck for movement on a surface to be painted, comprising:

a painting tool supporting member adapted to be mounted on the truck;

a first reciprocating mechanism connected to said painting tool supporting member and having a movable part movable in a direction toward and away from a surface to be painted;

a second reciprocating mechanism connected to said movable part of said first reciprocating mechanism and having a movable part movable in a direction parallel to the surface to be painted and an elastic part respectively disposed on both sides of said movable part, for adjustably driving said movable part by adjusting each length in said elastic parts; and a painting spray gun attached to said movable part of said second reciprocating mechanism and movable in response to the movement of said movable part of said first reciprocating member, whereby when the remotely controlled truck travels a distance over a surface where an obstacle exists, said painting spray gun can be moved to avoid the obstacle.

2. The painting tool of claim 1, further comprising a hood covering said second reciprocating mechanism.

3. The painting tool of claim 2, further comprising a suction nozzle for drawing in a paint mist from within said hood.

4. The painting tool of claim 1, wherein said movable part of said second reciprocating mechanism is movable across the path of travel of the truck.

5. The painting tool of claim 2, wherein said hood is in the form of a composite hood composed of a first hood associated with said movable part of said first reciprocating mechanism so as to cover an upper portion of said second reciprocating mechanism, a second hood associated with said painting tool supporting member so as to cover a lower portion of said second reciprocating mechanism, and a third hood disposed between said first and second hoods.

6. The painting tool of claim 5, wherein said third hood is made elastic.

7. The painting tool of claim 1, wherein said first reciprocating mechanism includes a stationary part attached to said painting tool supporting member, said movable part being reciprocatingly movable with respect to said stationary part.

8. The painting tool of claim 7, wherein said first reciprocating mechanism is constituted as a complex mechanism in which a plurality of reciprocating mechanisms each having said stationary part and movable part are disposed in parallel;

of said plurality of reciprocating mechanisms, the stationary part of the reciprocating mechanism on one end side is attached to said painting tool supporting member, whereas the movable part thereof is attached to the stationary part of the reciprocating mechanism adjacent thereto on the other end side;

of said plurality of reciprocating mechanisms, the stationary part of the reciprocating mechanism on the other end side is attached to the movable part of the reciprocating mechanism adjacent thereto on one end side, whereas attached to the movable part thereof is said second reciprocating mechanism; and of said plurality of reciprocating mechanisms, the stationary part of each of the other reciprocating mechanisms is attached to the movable part of a reciprocating mechanism adjacent thereto on one end side, whereas the movable part thereof is attached to the stationary part of a reciprocating mechanism adjacent thereto on the other end side.

9. The painting tool of claim 1, wherein said first reciprocating mechanism is in the form of a fluid pressure cylinder mechanism composed of a fluid pressure cylinder connected to said painting tool supporting member, and a piston rod which is a reciprocatingly movable within said fluid pressure cylinder, as said movable part.

10. The painting tool of claim 7, wherein said first mechanism is in the form of a fluid pressure cylinder mechanism composed of a fluid pressure cylinder connected to said painting tool supporting member, and a piston rod which is reciprocatingly movable within said fluid pressure cylinder, as said movable part.

11. The painting tool of claim 8, wherein said first reciprocating mechanism is in the form of a fluid cylinder pressure mechanism composed of a fluid pressure cylinder connected to said painting tool supporting member, and a piston rod which is reciprocatingly movable within said fluid pressure cylinder, as said movable part.

12. A painting tool comprising:

a painting tool supporting member;

a first reciprocating mechanism attached to said painting tool supporting member, the first reciprocating member having a movable part movable in a direction toward and away from a surface to be painted;

a second reciprocating mechanism attached to said movable part of said first reciprocating mechanism, the second reciprocating part having a movable part movable in a direction parallel to the surface to be painted;

a hood associated with the first reciprocating mechanism and covering said second reciprocating mechanism;

a suction nozzle for drawing paint mist from within the hood, the suction nozzle being attached to the hood; and a painting spray gun attached to said movable part of said second reciprocating mechanism whereby the painting pray gun can be moved toward and away from the surface to be painted to avoid an obstacle.

13. The painting tool of claim 12, wherein said hood is in the form of a composite hood composed of a first hood associated with said movable part of said first reciprocating mechanism so as to cover an upper portion of said second reciprocating mechanism, a second hood associated with said painting tool supporting member so as to cover a lower portion of said second reciprocating mechanism, and a third hood disposed between said first and second hoods.

14. The painting tool of claim 13, wherein said third hood is made elastic.

15. A painting tool comprising:

a painting tool supporting member;

a first reciprocating mechanism attached to said painting tool supporting member, the first reciprocating member having a fluid pressure cylinder movable in a direction toward and away from a surface to be painted;

a second reciprocating mechanism being attached to said fluid cylinder of said first reciprocating mechanism and having an expandable and retractable fluid bellow on both sides of said fluid cylinder of said first reciprocating member, said second reciprocating member movable, by the coordination of said fluid bellows, in a direction parallel to the surface to be painted; and a painting spray gun attached to said movable part of said second reciprocating mechanism whereby said painting spray gun can be moved toward and away from the surface to be painted to avoid an obstacle.

16. The painting tool of claim 15, further comprising a hood covering said second reciprocating mechanism.

17. The painting tool of claim 16, further comprising a suction nozzle for drawing in a paint mist from within said hood.

18. The painting tool of claim 15, wherein said painting tool supporting member is attached to a working device which runs on a surface to be painted.

19. The painting tool of claim 15, wherein said movable part of said second reciprocating mechanism is movable across the path of travel of the truck.

20. The painting tool of claim 16, wherein said hood is in the form of a composite hood composed of a first hood associated with said movable part of said first reciprocating mechanism so as to cover an upper portion of said second reciprocating mechanism, a second hood associated with said painting tool supporting member so as to cover a lower portion of said second reciprocating mechanism, and a third hood disposed between said first and second hoods.

21. The painting tool of claim 15, wherein said first reciprocating mechanism includes a stationary part attached to said painting tool supporting member, said movable part being reciprocatingly movable with respect to said stationary part, said stationary part being attached to said painting tool supporting member.

22. A painting tool comprising:

a painting tool supporting member;

a first reciprocating mechanism attached to said painting tool supporting member, the first reciprocating mechanism having a movable part being a plurality of fluid pressure cylinders movable in a direction toward and away from a surface to be painted;

a second reciprocating mechanism attached to said movable part of said first reciprocating mechanism, the second reciprocating mechanism having a movable part movable in a direction parallel to the surface to be painted; and a painting spray gun attached to said movable part of said second reciprocating mechanism whereby said painting spray gun can be moved toward and away from the surface to be painted to avoid an obstacle.

23. The painting tool of claim 22, further comprising a hood covering said second reciprocating mechanism.

24. The painting tool of claim 23, further comprising a suction nozzle for drawing in a paint mist from within said hood.

25. The painting tool of claim 23, wherein said hood is in the form of a composite hood composed of a first hood associated with said movable part of said first reciprocating mechanism so as to cover an upper portion of said second reciprocating mechanism, a second hood associated with said painting tool supporting member so as to cover a lower portion of said second reciprocating mechanism, and a third hood disposed between said first and second hoods.

26. The painting tool of claim 22, wherein said second reciprocating mechanism includes said movable part, and a pair of elastic parts respectively disposed on both sides of said movable part, for adjustably driving said movable part to adjust each length in said elastic parts.

* * * * *